United States Patent [19]

Nissinen

[11] Patent Number: 5,015,495

[45] Date of Patent: May 14, 1991

[54] METHOD FOR WET PAINTING OR POWDER COATING

[75] Inventor: Olli Nissinen, Saarijärvi, Finland

[73] Assignee: Valmet Oy, Finland

[21] Appl. No.: 619,359

[22] Filed: Jun. 11, 1984

Related U.S. Application Data

[63] Continuation of Ser. No. 378,017, May 13, 1982.

[30] Foreign Application Priority Data

May 22, 1981 [FI] Finland ..... 811583

[51] Int. Cl.[5] ..... B05D 3/14

[52] U.S. Cl. ..... 427/49; 427/388.1

[58] Field of Search ..... 427/49, 388.1

[56] References Cited

U.S. PATENT DOCUMENTS

| | | | |
|---|---|---|---|
| 768,754 | 8/1904 | Kitsee | 427/49 |
| 908,911 | 1/1909 | Vincent | 427/49 |
| 1,163,342 | 12/1915 | Hurley et al. | 427/49 |
| 1,822,484 | 9/1931 | Hartsough | 427/49 |
| 1,883,155 | 10/1932 | Watson | 427/49 |
| 2,594,096 | 4/1952 | Trigg | 427/49 |
| 3,224,900 | 12/1965 | Creamer et al. | 427/49 |
| 3,904,785 | 9/1975 | Baumann | 427/49 |

*Primary Examiner*—Janyce Bell

*Attorney, Agent, or Firm*—Steinberg & Raskin

[57] ABSTRACT

A method used in wet painting or in powder coating an object for accelerating the drying of the painted surface or the polymerization of the powder coating applied to the object. The object to be painted or coated is electrically coupled into an electric circuit so that it constitutes an electrical resistance in the circuit. When an electric current is passed through the circuit, the object is heated by virtue of the electrical resistance presented thereby to an elevated temperature suitable for the drying of the paint or for the polymerization of the powder coating. In wet painting, the temperature of the object is raised to about 60° to 80° C. and maintained at that temperature for about 0.5 to 2 hours. In powder coating, the temperature of the object is raised to about 180° to 200° C. with this temperature being maintained for about 15 minutes. Several objects to be heated can be coupled into an electric circuit, either in series and/or in parallel, so that the density of the current passing through the objects can be suitably adjusted to obtain the desired heating effect.

1 Claim, 1 Drawing Sheet

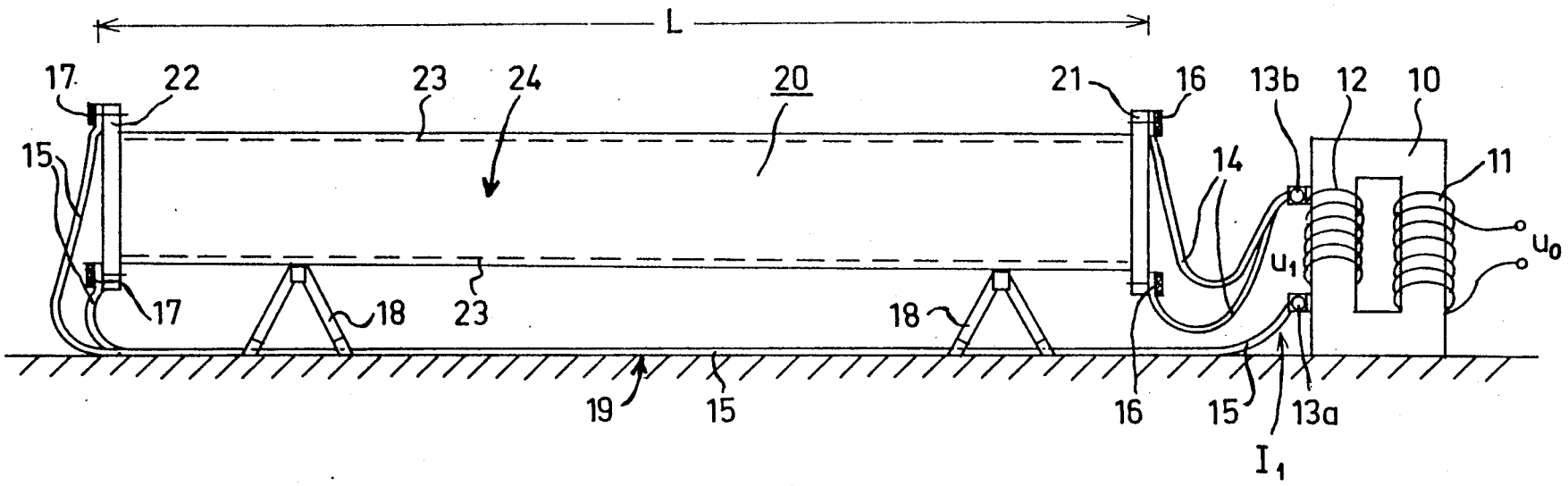
10
11
12
13b
13a
14
15
16
17
18
19
20
21
22
23
24
L
$U_0$
$U_1$
$I_1$

METHOD FOR WET PAINTING OR POWDER COATING

This is a continuation, of application Ser. No. 378,017, filed 5/13/82.

BACKGROUND OF THE INVENTION

The present invention relates to methods used in the wet painting or in the powder coating of an object for accelerating the drying of the painted surface of the object or of the polymerization of the powder coating thereof.

Heat is required in connection with both industrial type wet painting and electrostatic powder coating of objects. In the wet painting of objects, the application of heat increases the drying or reaction speed of the paint while in powder coating, the application of heat results in the polymerization of the powder coating. In the case of wet painting, the temperature of the object is usually raised to a value in the range of about 60° to 80° C. after both an intermediate painting stage as well as after the finish painting stage. On the other hand, in the case of powder coating, the temperature of the object is raised to the polymerization temperature which is generally in the range of about 180° to 200° C. In the latter technique, the object is usually raised to this temperature and maintained at such temperature for only about 15 minutes.

In the past, the elevated temperatures required by the wet painting and powder coating techniques have been obtained by resistance type circulating-air ovens or through the application of infra-radiation. Laser radiation has also been used to some extent in connection with the polymerization of powder coating on thin sheet objects.

These conventional techniques have drawbacks in that a large amount of heat energy is required to elevate the objects to the required temperatures. Moreover, the objects to be painted or coated must be shifted from place to place during the procedure. Furthermore, relatively large areas and specialized equipment are required for heating the painted or coated objects.

SUMMARY OF THE INVENTION

Accordingly, one object of the present invention is to provide new and improved methods in wet painting or in powder coating of objects for accelerating the drying of the painted surface of the object or the polymerization of the powder coating.

Another object of the present invention is to provide new and improved methods for the acceleration of the drying of the painted surface of an object or of the polymerization of the powder coating which are relatively simple and which eliminate the drawbacks inherent in conventional techniques as described above.

An additional and important object of the present invention is to provide a new and improved method for use in wet painting or in powder coating by which a painted or coated object is obtained having an improved quality and wherein the method is equally applicable both in wet painting and in electostatic powder coating.

Briefly, in accordance with the present invention, these and other objects are attained by providing a method wherein a painted or coated object, particularly an elongated beam-shaped, box-shaped or cylindrical object, is electrically coupled into an electrical current circuit so that the object itself constitutes an electrical resistance in the circuit whereupon an electric current is passed through the circuit so that the object is heated to an elevated temperature by virtue of the electrical resistance presented thereby. The object is heated to a temperature which is appropriate for the drying of the paint or for the polymerization of the powder coating.

Through the resistive or ohmic heating of the object in accordance with the invention, several important advantages are obtained. More particularly, since the electrical energy expended in heating the object is transferred directly into the object as compared to the conventional technique wherein the object is heated in a resistance-type circulating-air oven, less energy will be required to obtain a similar heating effect. The method of the invention is particularly well suited for use in connection with the wet painting or powder coating of steel beams since the specific heat capacity of steel is relatively low (W=0.46 kJ/°Kkg). Moreover, the time required for drying the paint or polymerization of the powder coating is significantly reduced through use of the method of the invention. For example, as set forth in detail below in connection with an illustrative example, the time required for the operation is reduced to 20% of that required for a corresponding process carried out at normal temperatures.

The method is particularly advantageous in that it is particularly suited for use in the painting or powder coating of structural objects, such as beams or the like, even where such objects include non-symmetrical structure such as bends, since the various parts of beams which are appropriately shaped to provide required mechanical strength will be substantially equally rigid and, therefore, attain substantially the same temperature.

Another important advantage provided by the method of the present invention is that in connection with the wet painting of objects, the drying will take place in the most suitable direction, namely, from the surface of the painted object.

Furthermore, the method of the present invention is particularly advantageous for use in connection with electrostatic powder coating in that the beam to be coated can be maintained at a sufficiently high temperature throughout the entire powdering operation so that the powdering can be carried out in a careful manner without reducing the temperature. Thus, in the past, it has been necessary to rapidly reduce the temperature during the powdering operation which has resulted in inferior workmanship.

Another important advantage provided by the present invention which is realized in connection with both the painting and powder coating of objects is that the usual necessity of shifting or moving the object is eliminated since the method of the invention can be carried out at a single location. This is especially important in the case where the object constitutes a long, heavy beam. It is yet a further important advantage that the space requirements for practicing the method are significantly reduced relative to the space requirements necessitated by conventional heating techniques, e.g., by resistance-type circulating-air ovens.

DESCRIPTION OF THE DRAWING

A more complete appreciation of the present invention and many of the attendant advantages thereof will be readily understood by reference to the following detailed description when considered in connection with the accompanying drawing in which:

The figure is a schematic illustration of one embodiment of apparatus for performing the method of the present invention.

DESCRIPTION OF THE PREFERRED EMBODIMENTS

Referring now to the drawing, the wet painted or powder coated beam 20, such as a beam used in a paper machine, is mounted on supports 18 which rest on a base 19. In the illustrative embodiment, the beam 20 has a hollow interior 24 and is formed with flange-like ends 21 and 22 which are integrally connected to the walls 23 of the beam.

According to the invention, the beam 20 is electrically coupled into an electric circuit so that the beam 20 itself constitutes an electrical resistance in the circuit. In the illustrated embodiment, the circuit includes a voltage source in the form of a transformer 10 which is illustrated for the sake of clarity as a single-phase transformer and without showing any rectifier equipment. The transformer 10 comprises a primary coil 11 and a secondary coil 12, the output terminals 13*a* and 13*b* of which are electrically coupled to the ends 21 and 22 of beam 20 by copper cables 14 and 15 having a sufficiently large cross-sectional area so as to be capable of carrying the requisite high amperage currents, for example, on the order of 1000 amperes or greater. The cables 14 and 15 are fastened to the ends 21 and 22 of beam 20 by fastening elements in the form of relatively large threaded fasteners 16 and 17 which may be passed through threaded bores normally provided in the ends of the beam. All electrical connections are preferably obtained in a manner so that junction resistances are eliminated or at least kept at a minimum.

In practice, the transformer 10 is a single-phase or three-phase transformer to the secondary winding of which rectifiers are preferably connected so that a direct current will pass through the circuit comprising the transformer secondary winding, the cables 14 and 15 and beam 20. The voltage provided by the secondary winding should preferably be adjustable in a conventional manner. In a typical example, the primary voltage of the transformer former $u_O=380$ volts, the secondary voltage $u_1=15$ to 25 volts (DC) and the power or rate of energy consumption $P=30$ kW.

As is well known, in the case where direct current passes through the circuit, the heating power $P=u_1 \cdot \times I_1=I_1^2\times R=u_1^2/R$, *where R is the resistance presented by the beam 20 between the ends 21 and 22 thereof. When the voltage values according to the above example are used, the heating current* $I_1$ passing through the circuit is on the order of about 1000 amps and it will therefore be seen that the cross-section of cables 14 and 15 must be suitably large to accommodate such current.

Depending on the secondary voltage produced by the transformer, the current passing through the circuit and the dimensions of the objects to be heated, the method of the invention may also be practiced in a manner such that several objects are electrically coupled by means of intermediate cables (not shown) into the circuit in parallel and/or in series therewith so that a current density will pass through the respective objects having a magnitude which is appropriate for heating the respective objects. In certain cases where the objects to be heated include, e.g., thinner portions whose electrical resistance will be higher than the resistance presented at other portions of the objects, it is possible to arrange the circuitry so that different voltages are applied across different portions of the object. For example, a different voltage will be applied across a thinner portion of the object than across a thicker portion thereof so that in this manner substantially equal heating effects will be obtained in all portions of the same object. Such arrangements of the circuitry will be readily apparent to a person skilled in the art.

A beam or other similar object can be heated according to the method of the present invention to a temperature in the range of between about 50° to 200° C.

Two illustrative and non-restrictive examples of the method of the present invention are now set forth.

EXAMPLE 1

The object to be heated is a carbon steel beam having a length of 2500 mm, a width of 400 mm, a height of 200 mm and a weight of 550 kg. The current or voltage source comprises a transformer provided with a rectifier and providing a secondary voltage $u_1$ of 14.5 volts and a power of 18 kW. The cables 14 and 15 are connected to the beams by means of threaded fasteners and nuts. Approximately 40% of the beam is provided with heat insulation in the form of "Karhuntalja" glass wool. The initial temperature of beam is about 20° C.

The temperature of the beam was observed and the rate of the increase in temperature has been recorded in the following table:

| Temperature (°C.) | Time (h) | Temperature is sufficient: |
|---|---|---|
| 60 | 0.6 | for wet painting |
| 106 | 1.5 | " |
| 140 | 2.0 | " |
| 180 | 3.1 | for electrostatic powder coating |

EXAMPLE 2

A carbon steel beam having similar dimensions to that described in Example 1 but having a U-shaped configuration and not the rectilinear configuration as was the case in Example 1 was used. The weight of the beam is 680 kg. The power in the electrical circuit was 18 kW and the secondary voltage $U_1=15$ volts. In connection with painting the object, an initial coating of zinc powder paint was applied one time, two intermediate coats of paint were applied at intervals of between 10 to 15 minutes and two coats of finishing paint were applied, again at intervals of between 10 to 15 minutes. The drying temperature was between 55° and 70° C.

A comparison was made between the drying time required utilizing a conventional method and using the resistive heating method of the present invention. In this connection, 20 hours was adopted as the conventional time period for evaporation and drying. The electric current was passed through the circuit for a total of 1.08 hours. It was found that the time required for the entire process was reduced by some 80% when using the method of the present invention. In this case, the thickness of the paint layer was 180 to 200 μm.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for accelerating the drying of a wet paint coating applied to an object for accelerating the polymerization of a powder coating applied to the object, the object being constituted by a structural beam formed of electrically conductive material, comprising the steps of:

applying a wet paint or polymerizable powder coating to the object;

electrically coupling the coated object at opposite ends thereof into an electric circuit so that the object constitutes an electrical resistance in the circuit; and passing an electric current through the circuit so that the coated object is heated by virtue of the electrical resistance presented thereby to an elevated temperature;

wherein the coated object coupled into the electric circuit has portions which present higher and lower electrical resistances and wherein different values of voltage are applied to the respective portions of the coated object so that the density of the current passing through the respective portions is substantially equal.

* * * * *